United States Patent [19]

Akamatsu

[11] Patent Number: 4,722,660

[45] Date of Patent: Feb. 2, 1988

[54] CENTRIFUGAL PUMP WITH A NUTATING IMPELLER

[76] Inventor: Teruaki Akamatsu, Room 208 Muromachiskyheights, Nakadachiurimuromachi, Kamigyo-ku, Kyoto 602, Japan

[21] Appl. No.: 913,885

[22] PCT Filed: Feb. 22, 1985

[86] PCT No.: PCT/JP85/00082

§ 371 Date: Sep. 5, 1986

§ 102(e) Date: Sep. 5, 1986

[87] PCT Pub. No.: WO86/04962

PCT Pub. Date: Aug. 28, 1986

[51] Int. Cl.[4] ..... F04D 33/00

[52] U.S. Cl. ..... 415/70; 415/208

[58] Field of Search ..... 415/70, 206, DIG. 4, 415/182, 184, 208, 205, DIG. 5, 143; 418/49

[56] References Cited

U.S. PATENT DOCUMENTS

| | | | |
|---|---|---|---|
| 2,353,373 | 7/1944 | Thompson | 418/49 |
| 2,773,453 | 12/1956 | Gemeinhardt | 415/70 |
| 3,132,493 | 5/1964 | Peckham et al. | 415/143 X |

FOREIGN PATENT DOCUMENTS

| | | | |
|---|---|---|---|
| 1216697 | 7/1956 | Fed. Rep. of Germany | 415/70 |
| 3133177 | 3/1983 | Fed. Rep. of Germany . | |
| 2114659 | 6/1972 | France . | |
| 720637 | 12/1954 | United Kingdom . | |

*Primary Examiner*—Robert E. Garrett
*Assistant Examiner*—Joseph M. Pitko
*Attorney, Agent, or Firm*—Wenderoth, Lind & Ponack

[57] ABSTRACT

The present invention is a centrifugal pump with a nutating impeller characterized in having a flow guide wall defining an annular space in a conical casing by projecting into the casing from the center of a circular end face of the casing. The flow guide wall also defines an inner face of the annular room and has an inlet open at the center of the end face of the casing. The centrifugal pump has a higher pump efficiency and a lower inverse flow and flow disturbance.

7 Claims, 7 Drawing Figures

FIG. 1
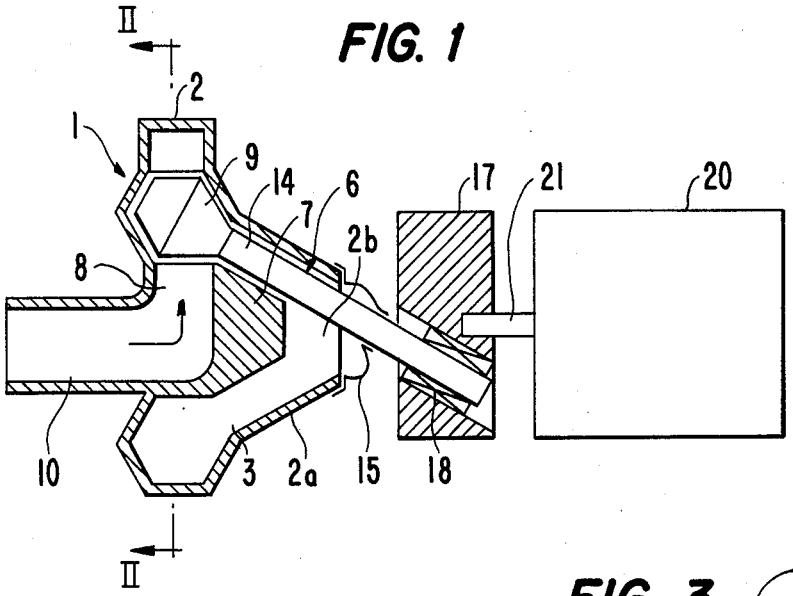
FIG. 3
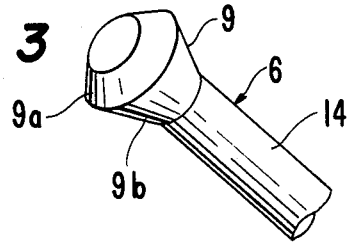
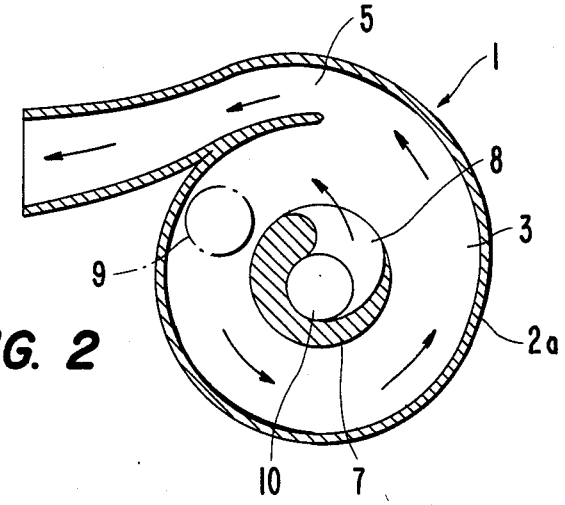
FIG. 2
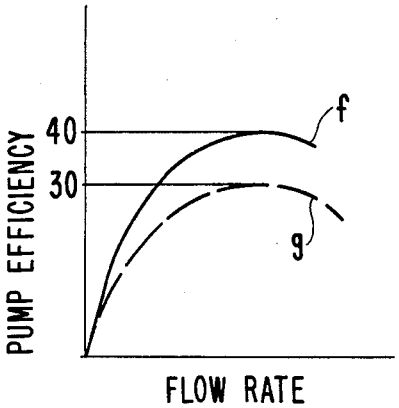
FIG. 7

CENTRIFUGAL PUMP WITH A NUTATING IMPELLER

BACKGROUND OF THE INVENTION

1. Field of the Invention

The present invention relates to a centrifugal pump, and more particularly to a pump which pumps out fluid rotated by a nutating impeller.

2. Description of the Related Art

A centrifugal pump which pumps out fluid rotated by a nutating impeller is disclosed in English Pat. No. 720637 and, German Patent Application Publication No. 3133177.

This pump is developed mainly for pumping fluid which must not be contaminated e.g. blood, and is characterized by having a nutating impeller.

The nutation of the impeller is an excellent suggestion in freeing fluid from inevitable contact with a bearing of a rotative impeller of a conventional pump.

But the pump has the defect of low pump efficiency, caused by fluid being forced to rotate without any restriction in the conical room enclosed by the casing of the pump.

On the other hand, another pump with a nutating impeller is disclosed in French Pat. No. 71.40652, but the pump has a defect not only of low pump efficiency caused by its inlet not being located at the center of the room in which the impeller is accommodated but also of the danger of inverse flow or flow disturbance in the room when the pressure at the outlet becomes large.

Especially during pumping of blood, the inverse flow or the flow disturbance in the pump room is unsatisfactory with regard to safety of and damaging of fluid components e.g. blood corpuscles.

SUMMARY OF THE INVENTION

The improvement of the pump efficiency and the prevention of inverse flow or flow disturbance in the pump room are very important when putting the pump of this type to practical use and the present invention proposes the improvement thereof.

That is, it is an object of the present invention to provide a centrifugal pump with a nutating impeller having a high pump efficiency.

It is another object of the present invention to provide a centrifugal pump which effectively prevents fluid components, e.g., blood corpuscles from being damaged which is caused by inverse flow or flow disturbance in the pump room.

To attain the stated objects, the present invention provides a centrifugal pump with a nutating impeller which is characterized by being provided with a flow guide wall defining an annular space in a casing by projecting into the casing from the center of the circular end face of the casing, the flow guide wall also defining an inner face of the annular space and being provided with an inlet open at the center of the circular end face of the casing.

The pump efficiency of the centrifugal pump of the present invention is greater than one not having a flow guide wall as shown by results from experiments. (In FIG. 7 f represents the pump of the present invention and g represents a pump that does not have a flow guide wall.)

A lesser flow disturbance in the pump room of the present invention is observed in experiments.

BRIEF DESCRIPTION OF THE DRAWINGS

The stated object and other characteristics of the present invention will be better understood by referring to the description of the embodiments of the present invention taken in conjunction with the accompanying drawings in which:

FIG. 1 is a side sectional view of a centrifugal pump according to the present invention;

FIG. 2 is a transverse sectional view taken along the line II—II of FIG. 1;

FIG. 3 is a perspective view of the impeller of FIG.1;

FIG. 7 is a graph showing the characteristic of flow rate to pump efficiency of a centrifugal pump according to the present invention compared with that of a conventional one.

DETAILED DESCRIPTION OF THE PREFERRED EMBODIMENTS

Figure 4:
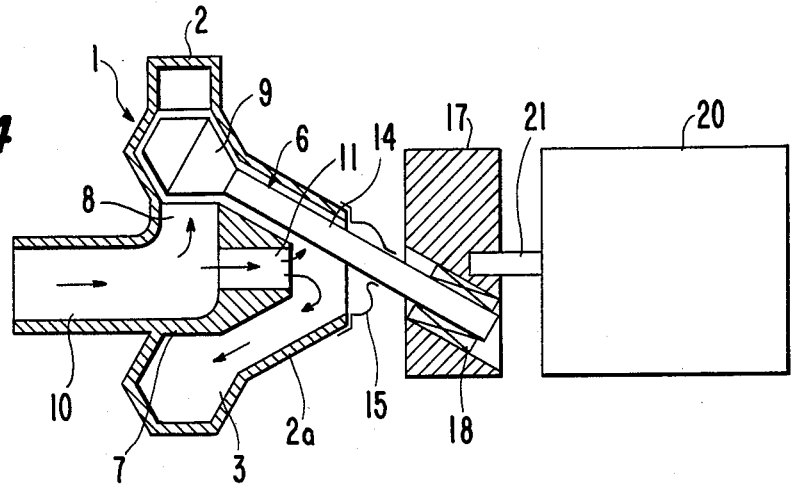
FIG. 4 is a side sectional view of another modification of a centrifugal pump according to the present invention.

FIG. 1 and FIG. 2 show an embodiment of the centrifugal pump of the present invention, the centrifugal pump (1) having an annular space (3) provided in a conical casing (2).

The casing (2) has a side wall (2*a*) formed in a conical shape and an opening (2*b*) provided at the apex portion thereof.

The outer face of the annular space (3) is confined by the side wall (2*a*) of the casing (2),and the inner face of the annular space (3) is confined by a flow guide wall (7).

The flow guide wall (7) projects into the casing room (3) from the center of the circular end face of the casing (2).

The annular space (3) is connected to the inlet (10) opened at the center of the circular end face of the casing (2) by the inlet way (8) which is a spiral flow way penetrating through the flow guide wall (7).

The annular space (3) is connected to an outlet (5) extending tangentially from the portion of the side wall (2*a*) of the casing (2) facing the inlet way (8), the portion of the side wall (2*a*) being smoothly expanded outward.

As shown in FIG. 3, the impeller (6) having a ball-like impeller head (9) which is comprised of a conical end portion (9*a*) and a base portion (9b) operatively extends in the annular space (3).

The impeller (6) extends along the side wall (2*a*) of the casing (2) and along flow guide wall (7) in the annular space (3) and has an impeller rod (14) which supports the impeller head (9) at the end thereof.

The base end portion of the impeller rod (14), which defines the base end portion of the impeller (6), extends through the opening (2*b*) of the casing (2) out of the annular space (3).

The opening (2*b*) is covered by a sealing membrane (15) made of flexible and durable material for reciprocal bending e.g. polyurethane.

The sealing membrane (15) is adhered to the side wall (2*a*) of the casing (2) and to the surface of the impeller (6) in a wide-tight manner.

The projected base end portion of the impeller (6) extending out of the annular space (3) is connected to the supporting member (17) through the bearing (18).

The supporting member (17) when rotated gives the impeller (6) a nutation with the center located in the opening portion (2*b*).

The said supporting member (17) is connected to the shaft (21) of a motor (20) and is rotated thereby.

In operation of the centrifugal pump of the present invention, the supporting member (17) is rotated by the motor (20) and thus the impeller (6) is nutated with the center located at the sealing membrane (15) of the opening (2*b*) portion.

Accordingly, the impeller (6) runs along the annular room (3) and gives rotation to the fluid in the annular room (3).

The fluid is pushed outward by a centrifugal force caused by the rotating flow along the annular space (3), flowing toward the outlet (5) from the annular space (3).

The flow is laminated because the fluid is constrained in the annular room (3) which is confined by the casing (2) and the flow guide wall (7).

As shown in the figures since the outlet (5) extends tangentially from the side wall (2*a*) of the casing (2) which is smoothly expanded outward and faces the inlet way (8), the interference between the flow intake from the inlet way (8) and the flow pushed toward the outlet (5) is prevented, and thus the flow disturbance is prevented to even a greater degree.

Accordingly the rotative movement of the impeller (6) is efficiently conveyed to the fluid.

On the other hand, the fluid intaked from the inlet (10) is supplied through the inlet way (8) into the annular room(3).

FIG. 4 shows another modification of a centrifugal pump according to the present invention, which has the following difference from that of FIG. 1.

That is, a flow way (11) is provided in the flow guide wall (7), the flow way (11) placing the inlet (10) in fluid communication with the apex portion of the annular space (3).

The flow way (11) is very useful for the prevention of the stagnation of the fluid in the apex portion of the annular room (3), which is especially important when the fluid is blood.

Figure 5:
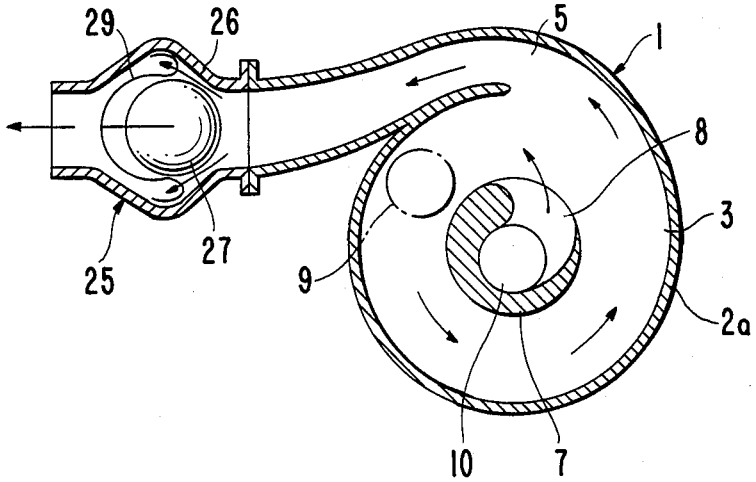
FIG. 5 is a side sectional view of another modification of a centrifugal pump according to the present invention.

FIG. 5 shows another modification of a centrifugal pump according to the present invention, which has the following difference from that of FIG. 1.

That is, a check valve (25) is connected to the outlet (5) the check valve (24) for preventing an inverse flow of fluid when the centrifugal pump (1) is pulsing during operation.

The check valve (25) shown in the figure has a ball (27) received in the cage (29) and is arranged to fit in the smoothly curved valve wall (26).

Figure 6:
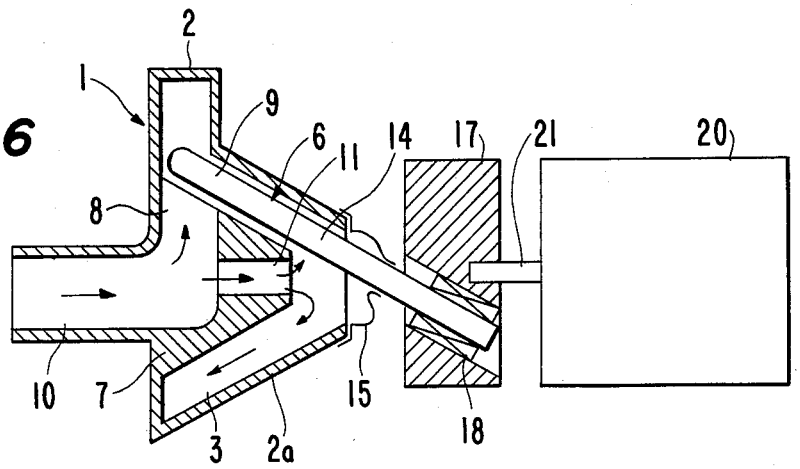
FIG. 6 is a side sectional view of another modification of a centrifugal pump according to the present invention.

FIG. 6 shows another modification of a centrifugal pump according to the present invention, which has the following difference from that of FIG. 1.

That is, the impeller (6) is a straight rod formed by an integral impeller head (9) and impeller rod (14).

The straight rod impeller (6) has an advantage in that it is easy to produce but has a defect in that it exhibits a little lower efficiency because the impeller head (9) is not expanded compared to the impeller (6) with a ball-like impeller head (9) shown in FIG. 3.

I claim:

1. A centrifugal pump comprising:

a generally conical casing one end of which is defined by a circular end face and the other end of which is defined by an open apex portion, the conical casing comprising a side wall extending from the circular end face to the apex portion;

a flow guide wall projecting into said conical casing from the circular end face, an annular space being defined between the flow guide wall and the side wall of the conical casing, said flow guide wall having an inlet way extending spirally therethrough and open to said annular space at a location on the flow guide wall;

an inlet extending through the circular end face and open to said inlet way;

an outlet open to said annular space at a position located on the side wall and extending therefrom in a direction that is substantially tangential to said side wall, said position on the side wall at which said outlet extends facing and disposed across the annular space from said location on the flow guide wall at which said inlet way is open to the annular space; and an impeller operatively disposed in the annular space, said impeller having a base end portion extending through said apex portion.

2. A centrifugal pump as claimed in claim 1, wherein said flow guide wall extends into said conical casing from a central part of the circular end face, and said inlet extends through the center of said circular end face.

3. A centrifugal pump as claimed in claim 1, and further comprising a sealing membrane disposed over said open apex portion, said membrane extending between and attached to the side wall of the conical casing and the base end portion of the impeller in a watertight manner.

4. A centrifugal pump as claimed in claim 1, wherein said outlet expands smoothly outward from said position in the tangential direction.

5. A centrifugal pump as claimed in claim 1, wherein said flow guide wall further has a flow way extending therein and open between said inlet and a space within the casing adjacent the apex portion.

6. A centrifugal pump as claimed in claim 1, wherein said impeller has an impeller head disposed in the annular space that is wider than the base end portion thereof.

7. A centrifugal pump as claimed in claim 1, wherein said impeller is a straight rod.

* * * * *